US007373867B2

(12) United States Patent
Ryan

(10) Patent No.: US 7,373,867 B2
(45) Date of Patent: May 20, 2008

(54) SYSTEM FOR NEUTRALIZING A CONCEALED EXPLOSIVE WITHIN A CONTAINER

(76) Inventor: Gregory Carl Ryan, County Road 209, Saratoga, WY (US) 82331

( * ) Notice: Subject to any disclaimer, the term of this patent is extended or adjusted under 35 U.S.C. 154(b) by 272 days.

(21) Appl. No.: 11/147,619

(22) Filed: Jun. 8, 2005

(65) Prior Publication Data

US 2006/0278069 A1 Dec. 14, 2006

(51) Int. Cl.
*F42B 33/00* (2006.01)

(52) U.S. Cl. ..... 86/50; 588/403

(58) Field of Classification Search ..... 86/50; 588/403; 110/237

See application file for complete search history.

(56) References Cited

U.S. PATENT DOCUMENTS 5,274,356 A * 12/1993 Taricco ..... 340/515
5,668,342 A * 9/1997 Discher ..... 86/50
6,173,662 B1 * 1/2001 Donovan ..... 110/237
6,244,155 B1 * 6/2001 Sparks ..... 86/50
6,354,181 B1 * 3/2002 Donovan ..... 86/50
6,758,151 B2 * 7/2004 Braithwaite et al. ..... 110/237
2005/0235814 A1 * 10/2005 Diebold ..... 86/50

* cited by examiner

*Primary Examiner*—James S Bergin
(74) *Attorney, Agent, or Firm*—Lee G. Meyer, Esq.; Meyer & Associates, LLC

(57) ABSTRACT

A system for neutralizing an explosive device concealed within an object by focusing a plurality of energies or fields including electromagnetic, electrostatic, magnetic, or acoustic toward the object thereby inducing detonation. A blast containment enclosure has means for focusing the energies or fields on the object, in a continuous fashion, to concentrate the energies at the contents of the object while protecting the surrounding by containment and/or redirection of a resulting explosion as well as feedback transducers for moderating the magnitude of the energies. A method for the neutralization of contained explosive devices is also provided.

25 Claims, 3 Drawing Sheets

SYSTEM FOR NEUTRALIZING A CONCEALED EXPLOSIVE WITHIN A CONTAINER

BACKGROUND

The present system relates to a system for detecting explosives concealed in an object or container, such as luggage, by selective detonation of the concealed explosive with a focused energy source. There has been an increased interest in devices for detecting explosives in, for example, airline luggage. This interest has been accelerated by the terrorist activity marked by Sep. 11, 2001. Many of these devices employ various types of radiation, which is absorbed or emitted in the presence of an explosive substance or device to leave a "foot print" on a detector. This is the concept of, for example, X-Ray.

The threat is amplified when charges are used to disperse chemical and biological agents upon detonation. This method of dispersal not only injures personnel and destroys property in the blast zone, but disperses secondary biological or biochemical agents. Dispersal in this manner makes detection and cleanup very difficult and allows a small devise to radiate biochemically active matter through a wide area.

In order to be effective, the method of detection of the explosive threat to aviation, mails, or shipping requires detection techniques that are highly sensitive, specific, rapid and non-intrusive. In the case of biological and chemical agents it also requires containment. The problem with the previous detection methods for the scanning of luggage, baggage and other parcels for explosive material contained or concealed within their confines is the time and inaccuracy of the process. For example, approximately two million pieces of luggage are checked and/or carried onto aircraft daily by over seven hundred and fifty thousand passengers at over six hundred airports in this country alone. Many more billions of parcels move through the mails, transportation companies and the like. Many of these parcels are destined for sensitive destinations.

The problem, thus, becomes the screening of a large number of items in a way that is efficient and effective. Because of the sheer number, screening all parcels is impractical, but those that have the potential of doing substantial harm can be isolated. Nevertheless, a secure, cost and time efficient system that has a very high probability of success is required.

Thus, the desired system to scan the luggage and parcels to detect the presence of any explosive material is not easily achieved. Prior art detection devices which "scan" the investigated object, like X-Ray, are the most common. This method relies on a trained operator to visually inspect the X-Ray image to determine the presence of explosives. The problem with this system is obvious. While guns and knives lend themselves to this type of detection, explosives such as C-4, hidden in, for example, soap, do not.

Another method of detection involves a radiated system for the detection of nitrogen, which is generally present in the explosive materials to be detected. The object under observation is positioned within a cavity structure and subjected to a bombardment of thermal neutrons. The thermal neutrons interact with any nitrogen contained in the object to induce the emission of gamma rays at an energy level characteristic of the nitrogen element. In general, prior art systems have not met the desired characteristics of having a high probability of detection with a low probability of false alarms at acceptable throughput rates.

A nuclear detection technique can provide for the detection of the nitrogen content to reliably indicate the presence of large nitrogen content. However, the frequent occurrence of nitrogen in non-explosive materials limits the level of detection sensitivity and merely detecting the presence or absence of nitrogen alone is not sufficient. Therefore, additional information is required beyond simply sensing the presence of the nitrogen. This vastly complicates such systems and increases the probability of false positives.

Although the efficient detection of nitrogen may be viable, to be effective, the detection of nitrogen must be able to give the maximum information of the physical parameters of the explosive, such as density and spatial distribution. The use of nuclear based techniques which subject the luggage or parcels to thermal neutrons has not, to-date, been effective in providing this information. It is important that the intensity, energy and spatial distribution of the detected radiations from the object under observation be provided in such a way so as to help to determine the presence or absence of explosives, and this has not yet been accomplished. This leads to a high number of false positives.

In addition to the nuclear based systems described above, non-nuclear systems have also been investigated. These systems have achieved relatively high efficiencies of detection, but generally have relatively high false alarm rates and have long screening times. These types of non-nuclear systems, therefore, by themselves cannot achieve the desired results. It is possible to combine a non-nuclear system with a nuclear system, but the effectiveness does not improve.

Other types of prior art explosive detection systems depend upon the prior seeding of explosive materials with a tracer material, such as a radioactive tracer. Although this type of system could be very useful if all explosive material were manufactured with such tracer material, because of the large amount of explosive material which has already been manufactured and because of the difficulty of controlling the manufacture of all explosive material so that they contain such tracer material, this type of system is not practical.

Ideally, a detection system must be able to detect the presence of explosive material of a conventional type and of an unconventional type, whether disposed within an object either in its original manufactured form, or if deployed within the object so as to attempt to confuse or evade the detection system. The prior art systems have not met these various criteria and cannot produce the desired high probability of detection with the relatively low production of false alarms.

In addition to high detection sensitivity and low false alarm, the detection of the explosive should be independent of the specific configuration and must be non-intrusive in order to protect privacy. The detection equipment, of course, must be non-hazardous to the contents of the checked items and to the operating personnel and environment. Other more general criteria are that the system must be reliable, easily maintained and operable by relatively unskilled personnel and that the cost must be low enough so as to be non-burdensome to airlines and airports. Finally, it is desirable, when all other requirements achieved that the size of the system be relatively small so that the system may be useful in a wide variety of environments.

Explosives, as a general rule, are by their very nature unstable compounds. Most are nitro-derivatives, which are set off by exciting molecules within the substance causing a chain, non-nuclear, chemical, exothermic reaction. Because of the fragile structure of an airplane, it does not take a substantial amount of an explosive material, properly placed, to destroy the aerodynamic characteristics of the plane. As set forth above, the prior art detection devices, which use, for example, X-Ray, Gamma-Ray, and the like, may be adequate for detecting naked explosive substances, they have been found inadequate where these substances are incased in materials such as soap, or the like, and then packed in large cases amongst other personal items, such as clothing. Thus, the only fool proof way of detecting the presence of these explosives is to detonate them prior to placing the case, or other object, onboard, for example, an airplane.

It is well known that explosives are substantially less stable than other compositions or compounds normally found within a container such as a parcel, baggage, brief case, or the like. Although, this is generally true, many explosives, such as C-4, are relatively immune to, for example, shock, pressure, and the like. However, these explosives require some sort of a detonator to trigger or activate the main charge. Thus, while particular explosive may not be sensitive to shock or heat, they do require a detonator which is much more sensitive to these conditions. Therefore, a bomb, charge, or explosive, designed to be detonated at a particular time or location, such as in a flying airplane, requires a detonator or triggering device to initiate the detonation of the primary charge. Therefore, an acceptable detection system need only provide sufficient energy to trigger the detonator.

Unfortunately, most prior art detonation systems do not focus the detonation energy on the container so that the least amount of energy can be effective in reaching the critical criteria in the shortest amount of time. Because of the myriad of parcel shapes and sizes, most inspection chambers do not provide for an intensity of directed energy. This failure requires long exposure times and/or a failed detonation of the contained explosive.

It would, therefore, be desirous to have a system for detection of explosives within a container which employs a minimum amount of examination time, and assures the greatest probability of focusing an effective amount of detonating energy on the contained explosive, irrespective of the nature, shape or composition of the explosive. It would also be desirous to have a secure system which would not only contain the ensuing blast, but neutralize or contain dispersed chemical or biochemical agents.

It will be realized that the foregoing discussion and examples of the related art and the scope of the illustrations related thereto are set forth as background only. Their intent is to be exemplary and illustrative of problems related to the art, as well as prior attempts to address these problems at least in part. They are not, nor are they intended to be exclusive or exhaustive. Nor are they intended, in any manner, to be read as a limitation of the instant disclosure or the appended claims.

SUMMARY

The following embodiments and aspects thereof are described and illustrated in conjunction with systems, devices and methods which are meant to be exemplary and illustrative, not limiting in scope. In various embodiments, one or more of the above-described problems have been reduced or eliminated, while other embodiments are directed to other aspect and improvements.

A system for neutralizing an explosive device concealed within an object by focusing at least one energy source selected from electromagnetic, electrostatic, magnetic, acoustic, or combination thereof, toward the object to induce detonation is provided. The system apparatus comprises an isolation enclosure and a detonation inducing system including at least one primary energy source for transmitting, emitting, or propagating an amount of energy through the object under investigation effective to detonate the device. The enclosure is a blast containment chamber having means for focusing the energies or fields on the object, in a continuous fashion, to concentrate the energies at the contents of the object. Advantageously, at least one compatible feedback transducer is provided to regulate the power of the transmitted, emitted, or propagated energy. The blast containment chamber protects the surroundings by containment and/or redirection of a resulting explosion. The chamber may employ, for example, a "blast vent" for relief of pressure and heat; and/or a bio-waste handling system. Advantageously, a bio-containment devise, such as a scrubber or thermal oxidizer, is coupled to the chamber.

In one aspect, the chamber communicates with a chamber compression and/or evacuation device, such as a displacement cylinder. The variation in pressure is used to "tune" and maximize the effect of the acoustical energy on the object, as well as cause pressure sensitive mechanisms to detonate. In another aspect, the chamber contains a turntable to revolve the object in a manner to more uniformly and evenly radiate the object and help prevent non-detection by stealth type explosive configurations and packaging. A method for the neutralization of contained explosive devices is also provided.

In addition to the summary of exemplary aspects and embodiments described above, further aspects and embodiments will become apparent to the skilled artisan by reference to the drawings and by study of the following descriptions all of which are within, without limitation, the scope of the claims.

BRIEF DESCRIPTION OF THE FIGURES

Exemplary embodiments are illustrated in referenced figures of the drawings. It is intended that the embodiments and figures disclosed herein are to be considered illustrative and exemplary rather than limiting. The features and advantages of the present invention, without limitation, are hereinafter described in the following detailed description of exemplary embodiments to be read in conjunction with the accompanying drawing figures and will be apparent to one skilled in the art that other embodiments are included, in view of the following, wherein like reference numerals are used to identify the same or similar parts in the similar views in which.

DETAILED DESCRIPTION OF THE INVENTION

Figure 1:
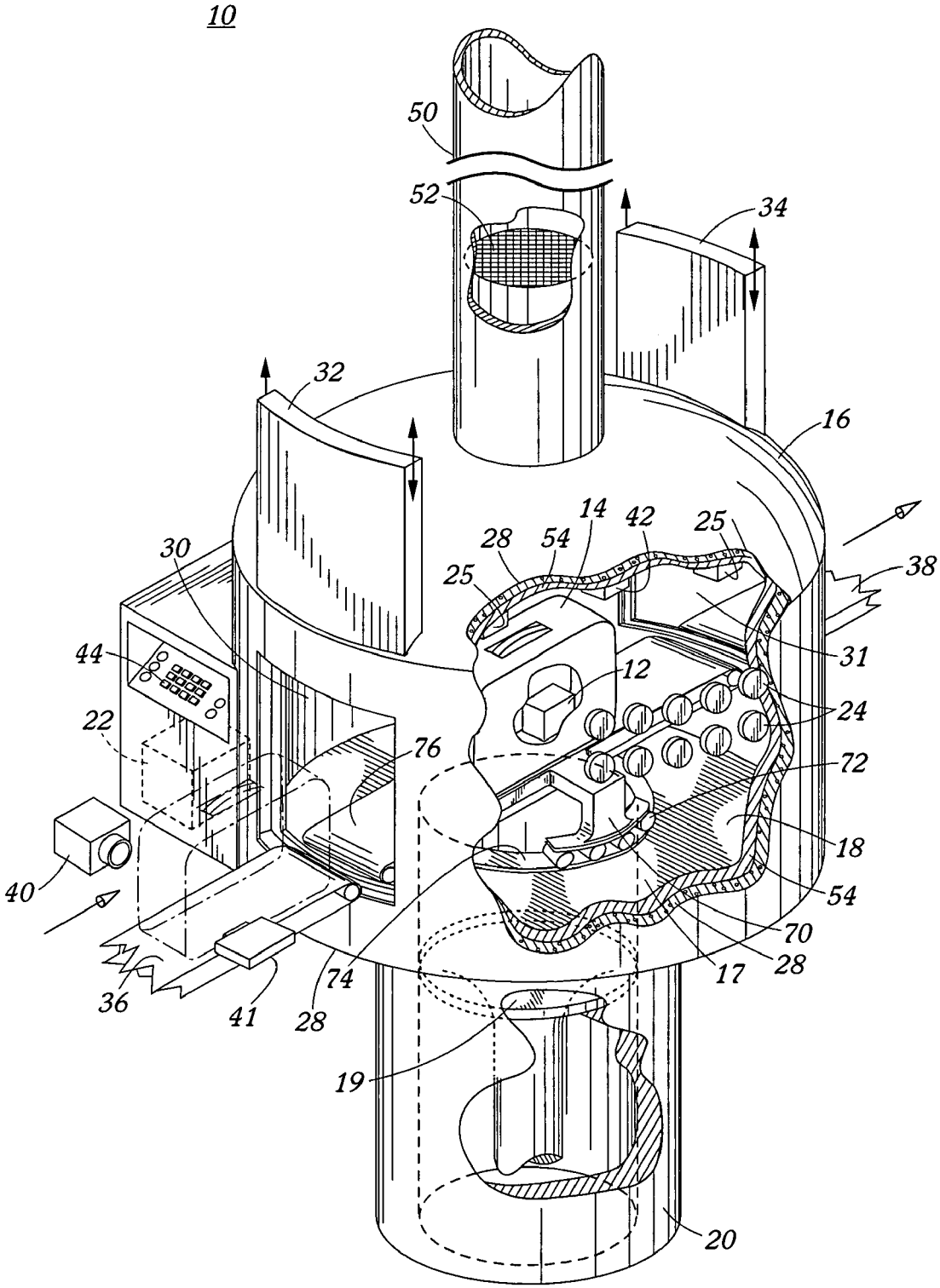
FIG. 1 is a perspective view of the detection apparatus including a partial cutaway showing the interior of the isolation enclosure containing luggage to be tested and a displacement cylinder to vary the pressure within the chamber.

The present system may be described herein in terms of functional block components and various processing steps. It should be appreciated that such functional blocks may be realized by any number of hardware and/or software components configured to perform the specified functions. For example, the system may employ various integrated circuit or optical components, e.g. memory elements, processing elements, logic elements, look-up tables, and the like, which may carry out a variety of functions under the control of one or more microprocessors or other control devices. Similarly, the software elements of the present invention may be implemented with any programming or scripting language such as C, C++, Java or the like.

In accordance with the system, an isolation enclosure structure, forming an explosion proof chamber, is provided with at least one sealable means for ingress. Advantageously, a pressure relief or exhaust port is provided, which is funneled to, for example, the exterior of a building (such as an airport) and provided with, for example, sound and flash baffles. The exhaust port also contains a valveing system to allow pressurization of the explosion proof chamber. In this embodiment, the integrity and construction requirements of the isolation enclosure structure can be somewhat diminished in that the explosion is not solely contained within the closed confines, but is allowed to vent through the pressure relief channel. Depending upon the use and environment, the exhaust port can communicate with a bio-hazard neutralization system, if desired. In another embodiment, the chamber communicates with a compression cylinder which relaxes (expands) in the presence of an explosion to reduce the blast pressure. The cylinder can be used exclusively, or in concert with the pressure relief port. The compression cylinder acts as a shock absorber expanding against resistance upon detonation. Primary energy sources are operatively connected to compatible actuators or emitters so that the selected type of primary energy is delivered to each such device (as will be described in detail below), to generate secondary energy which is focused within the chamber on the object to be investigated. Additionally, a particular method for utilizing multiple energy generators whose energy is transmitted through emitter and/or actuators arrays toward the article in a feedback transducer controlled environment is provided. Advantageously, a transfer apparatus is adapted to move objects to be investigated into and out of the explosion proof chamber through sealable openings. The examining platform is advantageously positioned on a turntable which can be actuated to rotate the platform and thus the object to provide more uniform energy application.

The system is effective in detecting a myriad of explosives by detonation. Although there are a large number of explosive types, a general classification into six major groups with minor variations, has been proposed. The proposed classification scheme includes the following types of explosives: (1) nitroglycerine based dynamites, (2) ammonium nitrate based dynamites, (3) military explosives, (4) homemade explosives, (5) low order powders, and (6) special purpose explosives.

Nitroglycerine based dynamites are the most common form of explosives. The basic composition includes equal amounts of nitroglycerine and ethylene glycol dinitrate, plus a desensitizing absorber in the form of cellulose in either sodium or ammonium nitrate. The ammonium nitrate based dynamites have been replacing nitroglycerine based dynamites in popularity. These types of dynamites are commonly referred to as slurries or water gels. The two general types of ammonium based dynamites are the cap-sensitive and the cap-insensitive types. The former consists of aluminum, ammonium nitrate, ethylene glycol and water while the latter contains wax or fuel oil and water. Military explosives are formed of Composition-4 (C-4), TNT and picric acid. C-4is composed of cyclotrimethylene trinitramine (RDX) and a plasticizer. Homemade explosives are diverse and are limited only by the creativity of the perpetrator. Ammonium nitrate (fertilizer) and fuel oil are the most common and available constituents.

Low order powders (black and smokeless) have typically been assembled in pipe bomb configurations and have been used extensively in that form. Black powder contains potassium nitrate, carbon and sulfur. Smokeless powder is primarily pure nitrocellulose or a mixture of nitrocellulose and nitroglyerine. Special purpose explosives include detonating cords, blasting caps and primers. The explosive entities in the special purpose explosives are PETN, lead azide, lead styphanate, mercury fulminate and blasting gel. All of the above explosives are believed susceptible to the sources and amounts of energy focused upon an object under investigation by use of the system.

In accordance with an advantageous embodiment, an apparatus comprising a cylindrical isolation enclosure including walls and at least one sealable door, a blast absorbent lining positioned inside the enclosure adjacent to the walls and each door, an exhaust duct attached to an opening formed through a wall of the enclosure and including, for example, a shrapnel screen, a plurality of sensing transducers as well as emitters are positioned inside the enclosure between the interior of the enclosure wall and the blast absorbent lining. Each emitter is adapted for directing a selected type of secondary energy or field into the explosion proof chamber upon receipt of a selected type of primary energy from a programmed primary energy source. In this manner, a program of specific energy emission can be affected which advantageously can be "tuned" to a specific object.

Advantageously, a belt-way or other suitable conveyance is used to transport the objects to be inspected into and out of the isolation enclosure. Explosion proof sealable openings, such as sliding doors or the like, are opened to allow object entry and then sealed. The object to be inspected is then subjected to the appropriate energy force, as will be further described, in accordance with, for example, a software cycling program which operates the emitters and/or pressurization valves and/or chamber reconfiguration mechanisms on a prescribed schedule. Advantageously, the examination platform within the chamber incorporates a turntable to subject the object to an even multidirectional energy force. This is especially useful for high energy emissions such as microwaves. The system includes energy emitters and actuators which include devices for subjecting the objects to a number of frequencies, magnitudes, and energy sources throughout a range designed to induce detonation.

An example of an isolation enclosure used to form an explosion proof chamber comprises a double-walled steel enclosure. In one embodiment, the walls, ceiling and floor are hollow. These hollow cavities are filled with shock damping material, such as silica sand or the like, and then covered with an explosion resistant surface or membrane.

Advantageously, the explosion proof chamber is vented and silenced, for example, through one or more vent pipes which take the blast force away from the explosion proof chamber. In one embodiment, a compression means, such as, for example, a hydraulic cylinder, communicates with the chamber. This compression means, when cycled, can evacuate and/or compress the atmosphere in the chamber to actuate pressure sensitive detonators and/or tune the acoustical energy within the chamber. Advantageously, the cylinder can be programmed to "relax" upon detonation, allowing the expanding gasses from the explosion to be dissipated by the increase in chamber volume caused by the retreating cylinder. In one embodiment, biological or biochemical agents dispersed by the detonation are neutralized by a thermal oxidizer and/or scrubber attached to the vent system. Nuclear radiation contaminants dispersed by detonation can also be handled by selective filtration and/or scrubbing. It will be realized by the skilled artisan that a myriad of devices and configurations are useful.

In one embodiment, a scanning device is positioned outside the chamber to initially screen items prior to moving the batch load into the test chamber. It is well known that certain materials will shield and otherwise protect explosive materials including detonation mechanisms from exterior bombardment with energy waves. In this manner, the explosives could be concealed within the object to be investigated in a manner such as to avoid detonation in accordance with the instant system. Therefore, it would advantageous, but not necessary, to use the system in series with, for example, a prescreening X-Ray detection system such that containers designed to shield explosives from energy wave bombardment could easily be detected and the object manually, visually inspected.

A control unit is operatively connected to the transfer apparatus, the screening device, the sealable chamber openings, the primary energy sources and an explosion sensor adapted to detect the occurrence of an explosion within the explosion proof chamber. In exemplary operation, a beltway or other suitable conveyance is used to transport the objects to be inspected into and out of the chamber. The explosion proof sealable openings, such as sliding doors or the like, are opened to allow object entry and then sealed. The object to be inspected is then subjected to the appropriate energy force, as will be further described, in accordance with, for example, a software cycling program which operates the emitters and/or pressurization valves and/or chamber reconfiguration mechanisms on a prescribed schedule, which includes subjecting the object to a number of frequencies, magnitudes, and energy sources through out a range designed to induce detonation. In one embodiment, the investigation platform within the explosion proof chamber comprises a turntable which during the investigation is caused to rotate to subject the object to more uniform energy treatment.

The luggage or container to be investigated, once placed into the explosion proof chamber which contains various means for focusing energies and/or fields upon the luggage or container to detonate explosive substances by direct excitation of the substance and/or closing detonation relays and switches on the device, and/or actuating pressure-sensitive devices, thereby neutralizing any concealed explosive devices through detonation, is then subjected to controlled energy. It will be realized by the skilled artisan that all of the functions of the unit may be automated by a programmable logic controller or personal computer to enable the unit to handle a total throughput in excess of for example 6-10 pieces per minute.

Exemplary of a suitable device is shown in the attached drawings which contemplate, for example, energies comprised singlely, or in combination, of acoustical, EMF, RF, microwave, and the like. These secondary energies are delivered by actuators and/or emitters placed within the chamber and are advantageously dynamically controlled by feed back transducers located in the chamber to detect the amount of energy which is non-deleterious to the container and objects within, but is of sufficient magnitude to detonate the explosive. In one embodiment, a compressor means is used to increase the pressure within the chamber to "tune" the acoustical energy through the container. In another embodiment, a vacuum may be pulled across the chamber to actuate pressure sensitive detonators and the like. In another embodiment, a means is provided, such as a hydraulic cylinder for vertically moving the object within the chamber to "tune" the energy emitter focus such that the object to be inspected is within the focal range of the emitter. In accordance with one aspect, which may occur in sequence, the energy sources utilized are picked for their ability to activate a detonator as opposed to the prime charge. Since the detonators are much more sensitive, they are much easier to active than the prime charge.

Turning to the drawings, there is shown in FIG. 1 the system 10 for neutralizing concealed explosive device 12 contained in luggage 14 by detonation. System 10 is comprised of a cylindrical isolation enclosure 16 and a detonation inducing system as will be further described. Cylindrical isolation enclosure 16 has an explosion proof chamber 18 formed therein to house luggage 14 for investigation. A compression cylinder sleeve 20, containing a piston 19, communicates with explosion proof chamber 18. Luggage 14 may be an individual article of luggage or baggage or it may be a "batch load" comprising a plurality of such packages, cargo, container or the like. Advantageously, the cylindrical isolation enclosure 16 is cylindrical in shape, but may be of any configuration. The cylindrical isolation enclosure 16 serves to contain and/or redirect the forces of an explosion occurring within explosion proof chamber 18 following the successful detonation of explosive device 12. Cylinder sleeve 20 acts as a shock and pressure absorbing chamber by displacement of piston 19. The excess pressures and gasses resulting from such explosion can be vented into the atmosphere by, for example, exhaust duct 50.

The detonation inducing system includes at least one primary energy source 22 and at least one emitter/actuator 24 compatible with the primary energy source 22. Each primary energy source 22 is adapted for the generation of a primary source of energy to be used by an emitter/actuator 24. Such energy may include microwaves, radio frequency energy, audio frequency energy, electrostatic, DC electrical currents and AC electrical currents (magnetic) and the like.

Each primary energy source 22 is advantageously located adjacent cylindrical isolation enclosure 16 to minimize the possibility of damage from an explosion. One skilled in the art will appreciate, however, that many locations for primary energy source 22 are feasible, provided an operative connection can be formed with emitter/actuator 24. Each emitter/actuator 24 is located within the explosion proof chamber 18. The compatible emitter/actuators 24 are adapted to receive the first type of energy from at least one primary energy source 22 and to direct a second type of emitted energy and/or field toward luggage 14 within explosion proof chamber 18.

Those skilled in the art will appreciate that the exact functional configuration of each emitter/actuator 24 will be dependent on the nature of the primary energy source 22 to which it is coupled. For example, where the primary energy source 22 is a magnetron or a klystron or other source of microwave frequency energy, emitter/actuator 24 may be a microwave antenna or wave guide; where the primary energy source 22 is a radio frequency generator, emitter/actuator 24 may be a directional radio frequency antenna; where the primary energy source 22 is an audio frequency generator, emitter/actuator 24 may be an audio frequency acoustic (speaker) device; and where the primary energy source 22 is a direct current or alternating current generator, emitter/actuator 24 may comprise magnetic coils or electromagnets. In addition, emitter/actuator 24 may be either a single emitter or a plurality in an "array" consisting of like emitters spatially arranged within explosion proof chamber 18.

The energy directed by emitter/actuator 24 at luggage 14 interacts with explosive device 12 so as to neutralize the explosive device through detonation. For purposes of illustration only, electro-explosive devices, such as blasting caps, may be detonated by directing short bursts of low frequency, high power energy in the radio frequency spectrum at luggage 14. Similarly, electromechanical relays and mechanical switches (including pressure sensitive switches) may be actuated by directing strong magnetic fields toward the luggage 14, to open or close electrical connections directly or cause deformation of components such as springs, diaphragms, or contacts to initiate explosive device 12. Preferably, these strong external magnetic fields are applied nearly parallel to the central axis of any coil or solenoid, and opposite to any armature or reed switch in explosive device 12. Therefore, one embodiment of the system includes electromagnets or coils (not shown) positioned within all walls of explosion proof chamber 18.

Further, acoustic energy in the form of audio frequency sweeps, i.e. audio frequency energy generated by primary energy source 22 which comprises, for example, a high power audio amplifier is directed at luggage 14 by emitter/actuator 24 which comprise audio emitters (e.g. audio speakers or the like). In one aspect, explosive device 12 may employ pressure sensitive switches as triggers. Such switches commonly utilize a sealed chamber to which a diaphragm or bellows is connected. Therefore, when ambient pressure acts on the diaphragm or bellows, the trapped air in the chamber is compressed, causing the diaphragm to distort in a convex or concave manner or cause the bellows to expand or contract, thereby closing switch contacts and initiating an explosion. When the resonant frequency of the sealed chamber of the pressure switch is produced (typically in the range of 30-14 10,000 Hertz), the diaphragm or bellows of explosive device 12 will vibrate with enough force to actuate the switch numerous times, thereby simulating numerous ascent and decent cycles of the aircraft and initiating the explosive device, even if pre-programmed to require numerous cycles.

In one aspect, the piston 19 in the cylinder sleeve 20 is employed to vary the pressure within explosion proof chamber 18 for a number of purposes. It will be realized the cylinder sleeve 20 can be of any size consistent with volumetric requirements. Thus, volumes which in effect double the size of the explosion proof chamber 18 are within the scope. First, pressurization and/or depressurization of the chamber can affect closure of pressure sensitive switches. Second, pressurization of the explosion proof chamber 18 can "tune" the chamber in a manner to intensify the effect of the acoustical energy. Additionally, the presence of the sleeve allows an expansion of the chamber under the resistance of the piston 19 to absorb the shock of the explosion by selectively increasing the volume of explosion proof chamber 18. In this manner the piston 19 acts as a "shock absorber."

The system thus allows the detection and neutralization of pressure sensitive explosive devices regardless of whether they emit electromagnetic noise when initiated and regardless of the number of preprogrammed pressure cycles. Moreover, this neutralization is accomplished directly by forced detonation without requiring periods of waiting for an initiated device to explode of its own accord. By simulating a number of aircraft ascent and decent cycles in a short period of time even preprogrammed devices can be detonated.

Still, other explosive devices 12, such as those whose primary explosive charge is detonated by a primer charge comprising a pyroignition mixture, may be detected and neutralized by directing high frequency energy in the micro wave range produced by primary energy source 22 which comprises magnetrons or klystrons at luggage 14 in short pulses, thereby producing sufficient heat in the material to cause detonation. Feedback transducers 25 are used to monitor the power of the directed energy to detonate the device without harming the contents of the object examined.

Referring again to FIG. 1, a plurality of primary energy sources 22 (not shown) producing different forms of energy will be coupled with a plurality of emitter/actuator 24 or emitter arrays 24 to increase the probability of detecting and neutralizing explosive device 12. The secondary energy emissions can be in parallel or series depending on the interference and time constraints. The sources may also be multi-spectral capable of generating energy waves of myriad of frequencies within an amplitude, as well as the ability to generate a single and or a number of differing amplitudes.

The following is by way of explanation and not limitation. Advantageously, standing wave patterns are directed and focused on the object to maximize the energy to effect detonation. When two waves of the same frequency meet while moving along the same medium, interference will occur to produce a resultant wave. Thus, the resultant is the addition of the two individual waves together in accordance with the principle of superposition. The result of the interference of these two waves is a new wave pattern referred to as a standing wave pattern.

Thus, standing waves are produced whenever two waves of identical frequency interfere with one another while traveling in opposite directions along the same medium. Standing wave patterns are characterized by certain fixed points along the medium which undergo no displacement. These points of no displacement are called nodes. These nodes are the result of the destructive interference of the two interfering waves. Midway between every consecutive nodal point are points which undergo maximum displacement. These points are called anti-nodes. Anti-nodes are points along the medium which oscillate between a large positive displacement and a large negative displacement. The anti-nodes are the result of the constructive interference of the two interfering waves.

The standing wave patterns of the system 10 are produced as the result of the repeated interference of these two waves to produce nodes and anti-nodes. The anti-nodes resulting from constructive interference of the two waves undergo maximum displacement (amplitude) from the rest position focusing substantial energy on the luggage 14. These standing waves can be produced from propagated waves traveling in opposite directions or a single propagated wave reflected from a barrier (like a wall). Both types are intended for inclusion herein.

The standing wave patterns of the system 10 can be produced at a number of frequencies such that each frequency is associated with a different standing wave pattern. These frequencies and their associated wave patterns are referred to as harmonics. In this manner, standing wave fields result in focused energy emissions at a specific location within the explosion proof chamber at the placement point of the object to be examined.

In order to tune the harmonics of acoustical waves, the density of the medium (air) within the explosion proof chamber can be changed. As previously described, the pressure (density of the medium) may be varied by means of moving piston 19 within cylinder sleeve 20. In addition to triggering pressure sensitive detonation trigger devices, the change in pressure intensifies the acoustical energy of the acoustical emitter delivered to the object.

Solely for illustration, the following description of, but one, exemplary system is set forth. Returning to FIG. 1, the cylindrical isolation enclosure 16 comprises a walled enclosure 28 having a sealable ingress passageway 30 formed therethrough and at least one closable portal door 32. As seen in FIG. 1, closable portal door 32 seals sealable passageway 30 while opposing closable portal door 34 forms a sealable egress passageway 31. Each closable portal door 32 and 34 is selectively movable between an open position (shown) which allows ingress and egress from cylindrical isolation enclosure 16 and a sealed closed position (not shown). Once the luggage 14 is within explosion proof chamber 18, the closable portal doors 32 and 34 are moved to their respective closed and sealed positions.

In an advantageous aspect for handling multiple objects such as in an airport, system 10 comprises a luggage handling apparatus comprising an ingress conveyer 36 for transferring luggage 14 into the cylindrical isolation enclosure 16 through sealable ingress passageway 30, and an output means comprising an egress conveyer 38 for transferring luggage out of said cylindrical isolation enclosure 16 through egress passageway 31. Those skilled in the art will appreciate that the use of belted conveyors will allow easy interface with the luggage handling systems in most airports, however, many other forms of luggage handling apparatus would be readily apparent.

System 10 also advantageously contains a means for venting or exhausting the blast products away from the explosion proof chamber 18. For example, explosion proof chamber 18 communicates with an exhaust duct 50 through the wall of cylindrical isolation enclosure 16. Exhaust duct 50 allows for venting pressurized explosion product generated within explosion proof chamber 18. Exhaust duct 50 may further comprise a shrapnel screen 52. Shrapnel screen 52 is advantageously positioned in the interior of exhaust duct 50 and acts to contain pieces of exploded shrapnel or debris within the cylindrical isolation enclosure 16, while allowing venting of excess pressures.

In FIG. 1, there is shown an advantageous aspect, which may be employed within the system 10. A turntable 70 is rotationally mounted on wheeled bearings 72, which movably rests on raceway 74 attached to the floor 17 of cylindrical isolation enclosure 16. Turntable 70 is structurally connected to internal conveyor 76 such that as turntable 70 is caused to move by motor means (not shown) internal conveyor 76 rotates therewith. In this manner, the system 10, when in operation, is able of exposing luggage 14 and, thus, concealed explosive device 12 to secondary energy from every angle of the object in a uniform manner. This prevents detonation devices from being packed in containers or shaped in a manner to present a stealth configuration to the electromagnetic energy produced within cylindrical isolation enclosure 16.

Figure 2:
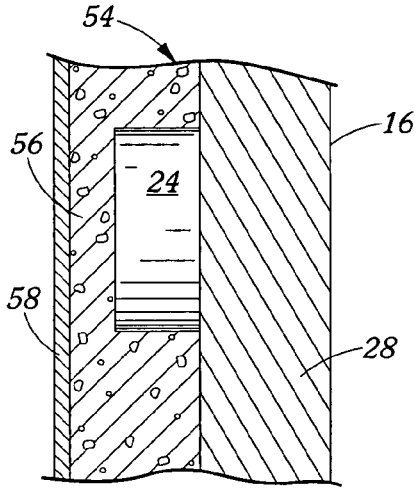
FIG. 2 is a partial sectional view of an exterior wall of the system in FIG. 1 showing the blast-resistant lining.

Cylindrical isolation enclosure 16 can be constructed, for example, in the following manner. Cylindrical isolation enclosure 16 may comprise a blast absorbent lining 54. Referring now to FIG. 2, blast absorbent lining 54 is shown positioned in the interior of cylindrical isolation enclosure 16 between explosion proof chamber 18 and enclosure wall 28. Emitter/actuator 24 is positioned within blast absorbent lining 54 proximate enclosure wall 28 so as to be protected from the effects of an explosion within explosion proof chamber 18. Blast absorbent lining 54 may comprise, for example, a blast resistant lining 56 of high density closed cell glass bead impregnated plastic foam, also known as syntactic foam; and a second layer 58 of fabric comprising an organic para-aramid fiber, PPD-T, also known under the trade name "Kevlar." Those skilled in the art will appreciate that many different configurations of blast resistant lining 56 are possible, including, as shown in FIG. 2, encapsulation of emitter/actuator 24 in syntactic foam, as shown, and the use of "Kevlar" in fabric form to further protect both the syntactic foam and the emitter/actuator 24, or the use of either syntactic foam or "Kevlar" alone, or the use of other shielding materials.

Figure 3:
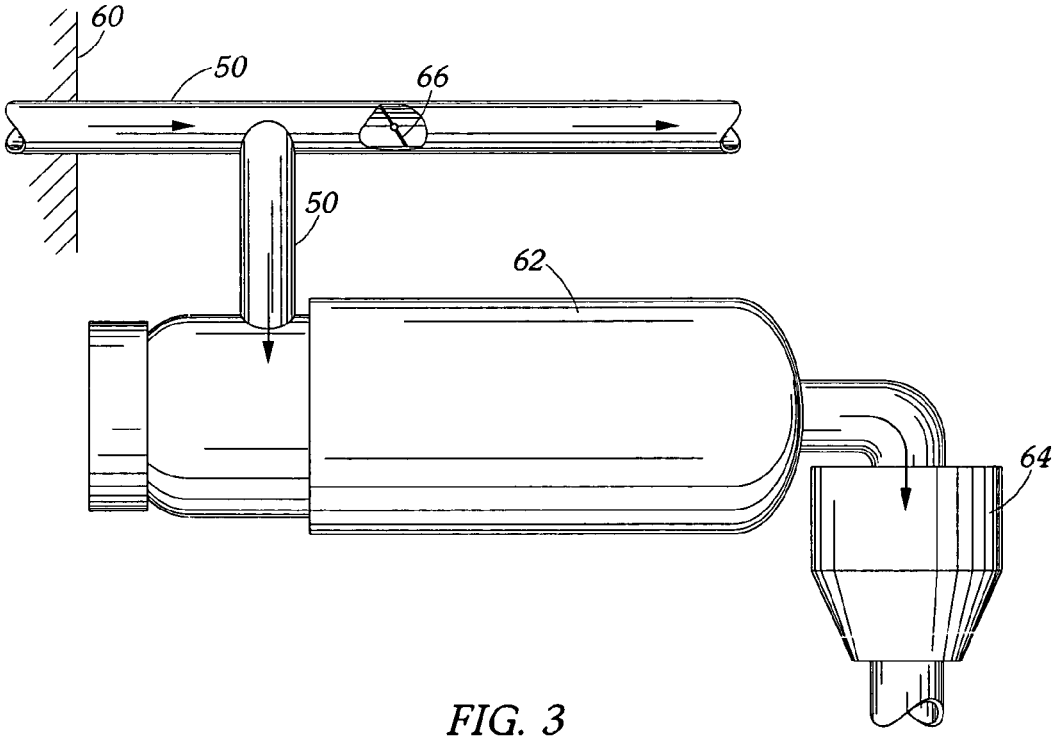
FIG. 3 is a bio-hazard neutralizing device comprised of a thermo-oxidation unit and a scrubber unit.

Turning to FIG. 3, there is shown a bio-hazard elimination exhausting system in accordance with one aspect of the described system. Exhaust duct 50 is extended exterior the building as illustrated by exterior wall 60 and "T"ed to a thermal oxidizing unit 62, which communicates with scrubber 64. As can be seen in FIG. 3, exhaust duct 50 contains a butterfly valve 66, which can be closed when objects suspected of containing bio-hazard or chemical warfare materials are being investigated. As previously disclosed, many times explosive devices within containers, luggage, packages, and the like are used solely for the purpose of conveying and/or distributing bio-hazard and/or chemical warfare materials over a large area. Bio-hazard materials could, for example, comprise anthrax spores. Once the detonation of the propagation explosion is accomplished within explosion proof chamber 18, the explosion products are contaminated with the bio-hazard/chemical warfare materials, which must be neutralized prior to disposal.

In accordance with this aspect, once the prime charge is detonated with butterfly valve 66 in the closed position, exhaust gases (as shown by the arrows in FIG. 3) exit the explosion proof chamber 18 through shrapnel screen 52 traveling through the "T" in the exhaust duct 50 into thermal oxidizer 62. Thermal oxidizer 62 is a piece of equipment well known to those skilled in the art, for oxidizing materials at very high temperatures, thus, thermally degrading them. These devices operate in the thousands of degree range and are effective in thermally degrading substantially all bio and chemical constituency in the exhaust stream.

Scrubber 64, which communicates with the exhaust stream of thermal oxidizer 62, can be any device well known in the art for isolating, or reacting, degradation product of the thermal oxidizer 62. Examples of such devices include packed columns, spray filtration, mole sieves, and the like. In operation, once the pressure within explosion proof chamber 18 has dissipated to ambient, piston 19 is actuated within cylinder sleeve 20 to compress the atmosphere of explosion proof chamber 18 exhausting the remainder of the contents. In accordance with this aspect, means are necessary for neutralizing the interior of the explosion proof chamber 18 (not shown) prior to opening the cylindrical isolation enclosure 16.

System 10 may also comprise X-Ray scanning device 40 to initially screen objects entering the explosion proof chamber 18 to detect items that are stored or packed in energy resistant containers. In this manner, these items can be examined manually by skilled personnel.

As previously disclosed, system 10 may also be automated to expedite the screening and to track items that have been successfully investigated within the system. An automatic control system includes an optical scanning device for tracking items such as by bar code (not shown), an explosion sensor 42 and a control unit 44. The identification scanner 41, such as an optical scanning device, is positioned to allow the scanning of luggage 14 prior to transferring the luggage into explosion proof chamber 18. It will be realized by the skilled artisan that the identification scanner 41 comprising an optical bar code scanner could scan optical bar code tags affixed to luggage 14 in a conventional manner. However, other forms of identification scanning could be used, including magnetic resonance, optical character recognition artificial intelligence means, and the like. Explosion sensor 42 is adapted to detect the occurrence of an explosion within explosion proof chamber 18. The explosion sensor 42 is a pressure detector, however, those skilled in the art will appreciate that other types of explosion sensors could be used, including light-detectors or heat-detectors positioned within the explosion chamber, or acoustic or impact-sensors positioned either inside or adjacent to cylindrical isolation enclosure 16. The explosion sensor 42 operates as a signal to the automated system that a detonation has occurred. The control unit 44 will trigger the appropriate response as set forth in FIG. 4.

Control unit 44 is operatively connected to the luggage handling conveyers 36, 38 and 76; closable portal doors 32, 34; primary energy source 22 and explosion sensor 42. Control unit 44 could sequentially operate system 10 in the following exemplary manner: ingress conveyer 36 moves batch load past the X-Ray scanning device 40 and then an identification scanner 41 which identifies article of luggage by means of, for example, a luggage tag bearing a bar code or a shipping label, allowing the information to be recorded, all as shown on the functional diagram in FIG. 4. Ingress conveyer 36 then transfers luggage 14 into the cylindrical isolation enclosure 16. After cylindrical isolation enclosure 16 has been sealed to the atmosphere by closing closable portal doors 32 and 34, primary energy source 22 is energized sending energy to emitter/actuator 24 located within explosion proof chamber 18 which, in turn, focus energy or fields, including standing waves, toward luggage 14, all as previously described. Feedback transducers 25 detect the energy intensity within the chamber and signal the primary source to boost or diminish the power or gain on emitter/actuator 24. In this manner, there is continual feedback to the system. Turntable 70 is actuated to rotate luggage 14 exposing the contents to uniform energy.

The energies or fields interact with explosive device 12 contained within luggage 14 causing detonation. The resulting blast is first contained by cylindrical isolation enclosure 16 and closable portal doors 32 and 34, and then vented to the atmosphere by exhaust duct 50. Piston 19 is caused to travel within the cylinder sleeve 20 to act as a shock absorber, as previously described. Shrapnel screen 52 traps expelled particles inside exhaust duct 50 to prevent them from being expelled into the atmosphere while the blast absorbent lining 54 protects cylindrical isolation enclosure 16, emitter/actuator 24, explosion sensor 42, and feedback transducers 25. If the object is inspected without detonation, closable portal doors 32 and 34 are opened and internal conveyer 76 and egress conveyer 38 operate to transfer luggage 14 from the explosion proof chamber 18.

Figure 4:
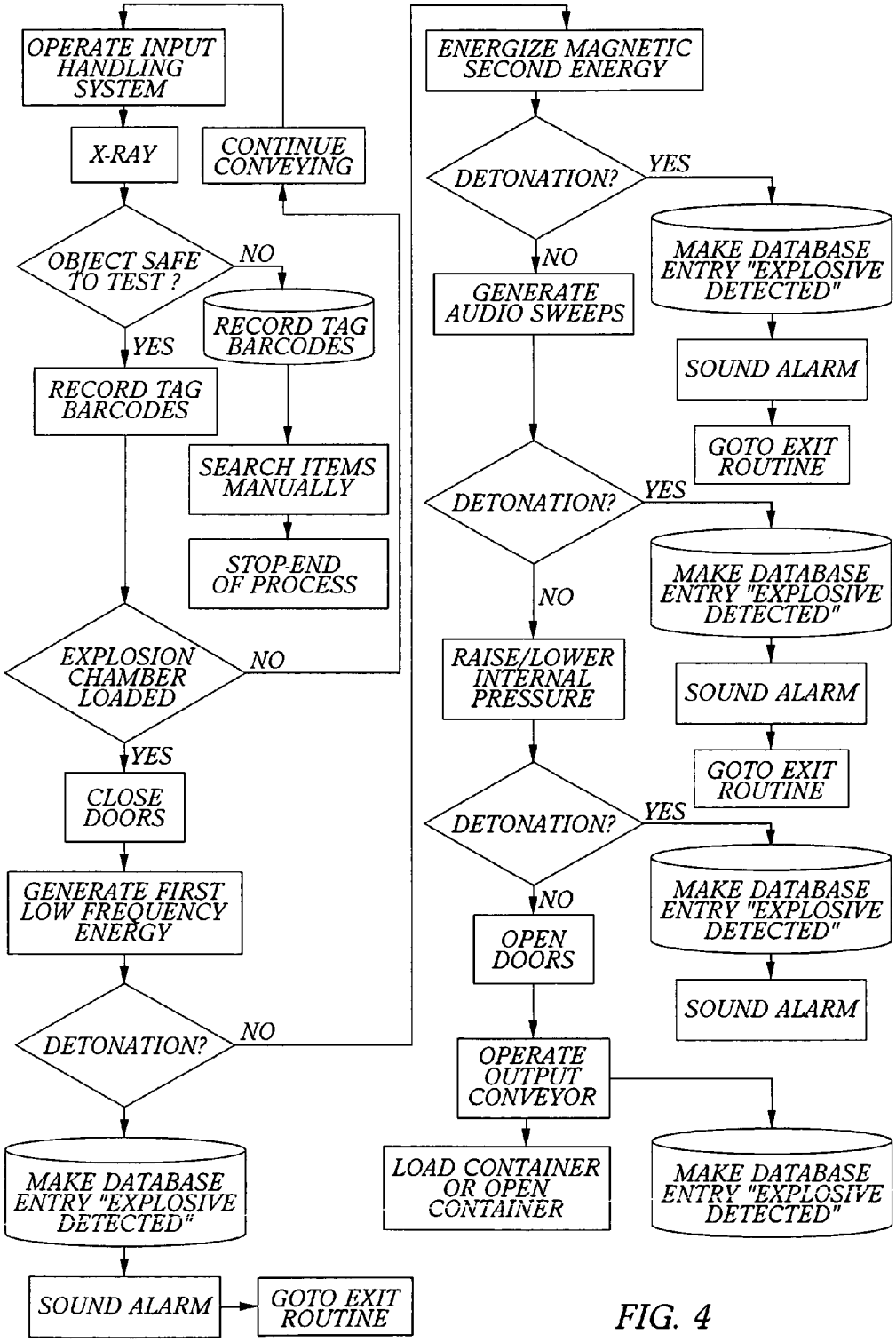
FIG. 4 is a flowchart showing an exemplary program for use by an automatic control unit of the system.

Advantageously, control unit 44 further comprises a microprocessor which automatically controls the sequence of operations involved in use of system 10. Referring to FIG. 4, an is provided. In addition to the detection and neutralization of concealed explosive devices, this invention provides a method for the detection and neutralization of explosive devices in a batch load comprising articles of baggage or luggage. Accordingly, a batch load suitable for testing in which each article of baggage or luggage has been identified, recording the identity of each article of baggage or luggage in a database; operating a transfer apparatus to position the batch load inside an explosion proof chamber; sealing the explosion proof chamber containing the batch load; performing the following steps for each instruction in a sequence comprising a plurality of instructions, each such instructions specifying an exemplary selected primary energy generator and selected settings therefore. First, generating a selected type of primary energy using the selected primary energy generator and the selected settings therefore specified by the instruction; and, transmitting the selected primary energy from the selected generator to a compatible emitter positioned inside the chamber. Then, energizing the turntable to rotate the batch load and energizing the piston 19 selectively pressurize and/or depressurize the chamber. Directing the secondary type of energy or field from the emitter upon receipt by the emitter of the energy from the primary generator, the secondary energy being directed at the batch load in the test chamber such as to affect a standing wave pattern proximate the batch load. Modulating the energy by means of instructions and monitoring the energy intensity within the chamber through feedback transducers. Detecting the presence or absence of an explosion within the test chamber using an explosion sensor; and, continuing operation where no explosion is detected or generating an alarm signal and halting further operations where an explosion is detected. Unsealing the isolation chamber; making a database entry that the testing of articles in the batch load is completed; and operating the transfer apparatus to move the batch load out of the isolation enclosure.

Although the system and method of the present invention have been described with respect to specific embodiments thereof, various changes and modifications to the preferred embodiments may be suggested to those skilled in the art, and it is intended that the present invention encompass such changes and modifications as fall within the scope of the appended claims.

All of the methods and systems disclosed and claimed herein can be made and executed without undue experimentation in light of the present disclosure. While the methods and systems of this invention have been described in terms of embodiments, it will be apparent to those of skill in the art that variations may be applied to the methods and systems and in the steps or in the sequence of steps of the methods described herein without departing from the concept, spirit, and scope of the invention. Various substitutions can be made to the hardware and software systems described without departing from the spirit of the claimed invention. All such similar substitutes and modifications apparent to those skilled in the art are deemed to be within the spirit, scope, and concept of the claimed invention.

What is claimed is:

1. A system for neutralizing an explosive device concealed in a container without substantially deleteriously effecting the container or the non-explosive contents therein by selective detonation of the explosive device comprising:

a.) an isolation enclosure forming an explosive proof chamber for retaining the container and having at least one sealable portal for ingress and egress and a blast vent or compression cylinder in communication with said explosion proof chamber for relief of pressure and heat;

b.) at least one regulatable primary energy source for transmitting, emitting, and/or propagating a controlled, focused amount of energy on the container;

c.) at least one feed back loop located in said chamber for each of said at least one primary energy sources to monitor the amount of energy being emitted from said at least one regulatable primary energy source;

d.) at least one regulator in communication with said feedback loop for controlling the amount of energy being emitted from each of said at least one regulatable primary energy source wherein said amount of controlled, focused energy from said at least one energy source is effective to detonate the explosive device within the container, but insufficient to deleteriously effect said container or the non-explosive content therein.

2. The system of claim 1 wherein the regulatable primary energy source is selected from electromagnetic, electrostatic, magnetic, acoustic, or combinations thereof.

3. The system of claim 1 wherein the controlled focused amount of energy comprises a standing wave pattern.

4. The system of claim 1 wherein the regulatable primary energy sources are multi-spectral, being capable of generating energy at a myriad of frequencies within an amplitude and a number of differing amplitudes.

5. The system of claim 1 further comprising a cylinder sleeve in communication with the isolation enclosure having a piston for selectively pressurizing and depressurizing the explosive proof chamber to tune a acoustic energy from the acoustic primary energy source.

6. The system of claim 1 wherein at least one feed back loop located in said chamber comprises at least one compatible feedback transducer to regulate the power of the transmitted, emitted, or propagated energy.

7. The system of claim 1 further comprising a turntable to revolve the container in a manner to more uniformly and evenly subject the container to the controlled, focused amount of energy.

8. The system of claim 1 wherein the regulatable primary energy source is selected from a magnetron source of microwave frequency energy which actuates an emitter/actuator in the form of a microwave antenna or wave guide; a radio frequency generator which actuates an emitter/actuator directional radio frequency antenna; an audio frequency generator which actuates an emitter/actuator in the form of an audio frequency acoustic device; a direct current or alternating current generator which actuates an emitter/actuator comprising magnetic coils or electromagnets, and combinations thereof.

9. The system of claim 1 wherein the at least one regulatable energy source comprises a plurality of regulatable energy sources which actuate a plurality of focused, controlled emitter/actuators in an array consisting essentially of a plurality of like emitter/actuators spatially arranged within the explosion proof chamber.

10. The system of claim 1 further comprising a biological or chemical handling system in communication with said blast vent.

11. The system of claim 1 further comprising a transfer apparatus adapted to move the containers into and out of the explosion proof chamber through the at least one sealable portal.

12. The system of claim 11 further comprising an automatic control system including:

(a) a scanning device being positioned to allow scanning the container prior to transferring the container into the explosion proof chamber;

(b) an explosion sensor for detecting the occurrence of an explosion within the explosion proof chamber;

wherein the automatic control system is operatively connected to the container transfer apparatus, the scanning device, the at least one sealable portal for ingress and egress, the at least one primary energy source for transmitting, emitting, or propagating a focused amount of energy on the container effective to detonate the explosive device in the container, and the explosion sensor.

13. A method for neutralizing an explosive device concealed in a container by detonation of the explosive device without deleteriously affecting the container or the non explosive contents thereof comprising the steps of:

a.) retaining the container in an isolation enclosure forming an explosive proof chamber having at least one sealable portal for ingress and egress and a pressure relief means in communication with said explosion proof chamber for relief of pressure and heat from an explosion;

b.) sealing the explosion proof chamber; and, c.) focusing a controlled amount of energy on the container from at least one transmitting, emitting, or propagating regulatable primary energy source;

d.) monitoring the amount of energy being emitted from the at least one transmitting, emitting, or propagating primary energy source;

e.) controlling the amount of focused energy at the container effective to detonate the explosive device, but insufficient to deleteriously effect said container or the non-explosive contents therein.

14. The method of claim 13 wherein the regulatable primary energy source is selected from electromagnetic, electrostatic, magnetic, acoustic, or combinations thereof.

15. The method of claim 13 wherein the effective amount of controlled energy comprises a standing wave pattern.

16. The method of claim 13 wherein the regulatable primary energy sources are multi-spectral being capable of generating energy at a myriad of frequencies within an amplitude and a number of differing amplitudes.

17. The method of claim 13 wherein comprising the further step of selectively pressurizing and depressurizing the explosive proof chamber to tune the acoustic energy.

18. The method of claim 13 wherein the step of regulating the power of the transmitted, emitted, or propagated energy is by means of at least one compatible feedback transducer.

19. The method of claim 13 comprising the further step of revolving the container within the explosion proof chamber in a manner to more uniformly and evenly subject the container to the controlled, focused amount of energy.

20. The method of claim 13 wherein the primary energy source is selected from a magnetron source of microwave frequency energy and actuating an emitter/actuator in the form of a microwave antenna or wave guide; a radio frequency generator, actuating an emitter/actuator directional radio frequency antenna; an audio frequency generator actuating an emitter/actuator in the form of an audio frequency acoustic device; a direct current or alternating current generator actuating an emitter/actuator comprising magnetic coils or electromagnets and combinations thereof.

21. The method of claim 13 wherein the at least one regulatable energy source comprises a plurality of regulatable energy sources which actuate a plurality of focused, controlled emitter/actuators in an array consisting essentially of a plurality of like emitter/actuators spatially arranged within the explosion proof chamber.

22. The method of claim 13 wherein said pressure relief means in communication with said explosion proof chamber for relieving the pressure and heat from the explosion proof container upon detonation of the explosive device comprises a blast vent.

23. The method of claim 13 comprising the further step of neutralizing biological and chemical contaminants from the explosion proof container upon detonation of the explosive device.

24. The method of claim 13 comprising the further step of transferring the containers into and out of the explosion proof chamber through the at least one sealable portal.

25. The method of claim 24 comprising the further steps of:

(a) scanning the container prior to transferring the container into the explosion proof chamber;

(b) detecting an explosion within the explosion proof chamber.

* * * * *